US005408927A

United States Patent [19]

Gallagher et al.

[11] Patent Number: 5,408,927

[45] Date of Patent: Apr. 25, 1995

[54] TAX STAMP MACHINE

[75] Inventors: Dennis M. Gallagher, Danbury; Thomas M. Pfeifer, Bridgeport, both of Conn.

[73] Assignee: Pitney Bowes Inc., Stamford, Conn.

[21] Appl. No.: 304,313

[22] Filed: Sep. 12, 1994

[51] Int. Cl.[6] ..... B41F 13/24

[52] U.S. Cl. ..... 101/232; 101/91; 271/259; 271/226; 271/227

[58] Field of Search ..... 101/232, 233, 234, 235, 101/236, 237, 91; 271/245, 246, 256, 257, 258, 259

[56] References Cited

U.S. PATENT DOCUMENTS

| | | | |
|---|---|---|---|
| 3,734,011 | 3/1973 | Williams | 101/91 |
| 3,898,930 | 8/1975 | Ikegami et al. | 101/233 |
| 4,552,065 | 11/1985 | Billington et al. | 101/91 |
| 4,630,210 | 12/1986 | Salazar et al. | 101/91 |
| 4,643,089 | 2/1987 | Salazar et al. | 101/91 |
| 4,743,129 | 5/1988 | Keryhuel et al. | 101/233 |
| 4,864,505 | 9/1989 | Miller et al. | 101/91 |
| 5,224,416 | 7/1993 | Malin et al. | 101/91 |
| 5,251,554 | 10/1993 | Eckert, Jr. et al. | 101/91 |
| 5,337,660 | 8/1994 | Eckert, Jr. et al. | 101/91 |
| 5,339,100 | 8/1994 | Mistyurin | 101/91 |

*Primary Examiner*—Eugene H. Eickholt

*Attorney, Agent, or Firm*—Melvin J. Scolnick; David E. Pitchenik; Steven J. Shapiro

[57] ABSTRACT

A tax stamp machine for printing tax stamps on documents. The tax stamp machine includes: a housing; a registration point marked on the housing; a feed deck for receiving documents; a device for printing a tax stamp on a portion of the documents; a pair of drive rollers for feeding the documents to the printing device; and a device for indexing the drive rollers to thereby register the documents with the registration point prior to printing the tax stamp.

8 Claims, 1 Drawing Sheet

TAX STAMP MACHINE

BACKGROUND OF THE INVENTION

The instant invention relates to machines for printing tax stamps on documents, and more particularly to a mailing machine which is modified in order that a tax stamp can be printed in any desired location on the document being stamped.

Tax stamp machines are well known in many industries where it is necessary to print a tax stamp on a document or container to indicate that a particular tax has been legally paid to appropriate authorities. For example, there are cigarette tax stamping systems in use today which print a cigarette tax stamp on a carton containing ten packs of cigarettes. However, many applications involving tax stamps require that the tax stamp be printed on a document. Typically, the printing is effected by a mailing machine that has been converted to a tax stamp machine.

A typical tax stamp machine which has been converted from a mailing machine resembles a regular mailing machine except that the drive rollers which normally would feed an envelope to the meter are removed, which allows the document to be printed with a tax stamp to be manually fed to the printing meter. With a manual feed of the document to the printing die, obviously the tax stamp will not be uniformly located with respect to the leading edge of the document.

Thus, the instant invention provides a tax stamp machine which assures that the tax stamp will be uniformly located with respect to the leading edge of all documents being processed by the tax stamp machine. Additionally, the instant invention provides the capability of adjusting the location of the tax stamp with respect to the leading edge of the document.

SUMMARY OF THE INVENTION

Accordingly, the instant invention provides a tax stamp machine for printing tax stamps on documents. The tax stamp machine includes: a housing; a registration point marked on the housing; a feed deck for receiving documents; means for printing a tax stamp on a portion of the documents; a pair of drive rollers for feeding the documents to the printing means; and means for indexing the drive roller to thereby register the documents with the registration point prior to printing said tax stamp.

DETAILED DESCRIPTION OF THE PREFERRED EMBODIMENT

Figure 1:
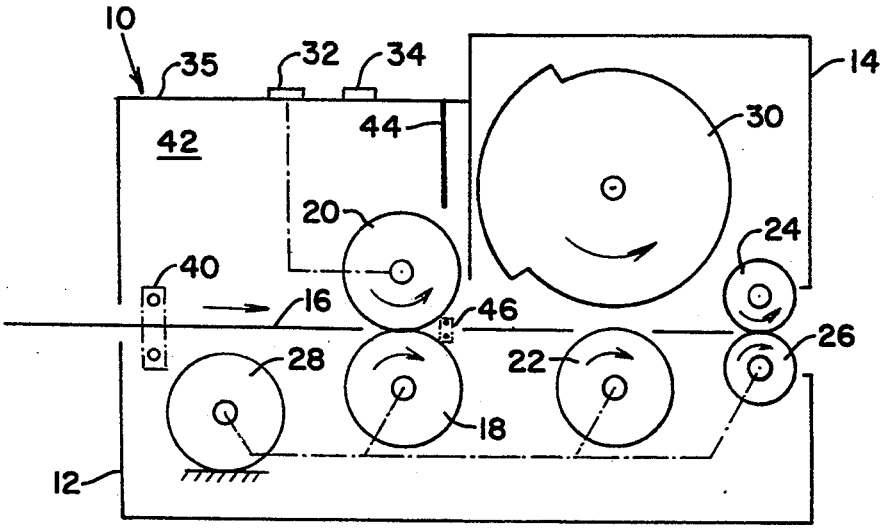
FIG. 1 is a schematic, side, elevational view of a tax stamp machine in accordance with the instant invention.

In describing the preferred embodiment of the instant invention, reference is made to the drawings, wherein there is seen in FIG. 1 a tax stamp machine generally designated 10 consisting of a modified mailing machine 12 and a modified postage meter 14. The modified mailing machine 12 includes a feed deck 16, a pair of drive rollers 18 and 20, an impression roller 22 and a pair of ejection rollers 24 and 26. A motor 28 is operatively connected to the aforementioned rollers 18, 20, 22, 24 and 26 to drive said rollers in conventional manner. The meter 14 includes a printing die 30 driven by a separate motor (not shown) in conventional manner. The die 30 is so designed to print the appropriate stamp.

The modified mailing machine 12 further includes a print key 32 and a stepping or indexing key 34 on a control panel 35. The keys 32 and 34 will be explained in further detail hereinbelow. Located upstream of the drive rollers 18 and 20 is an auto-on sensor 40. The modified mailing machine 12 includes a registration wall 42 which includes at its downstream end a registration mark 44. The mailing machine 12 further includes a trip sensor 46 which is aligned with the registration mark 44.

Figure 2:
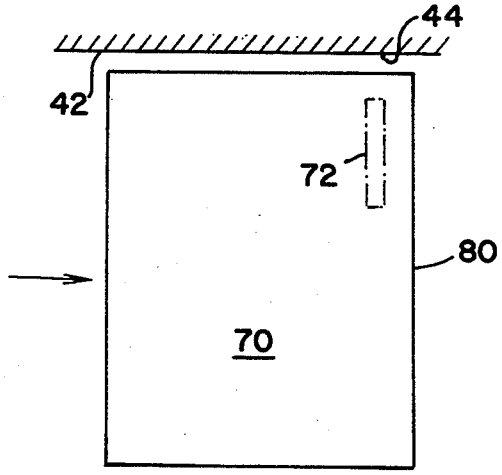
FIG. 2 is a top, plan view of a document and the registration mark, and a dotted rectangle indicating where the tax stamp would be printed.

The operation of the tax stamp machine 10 will now be described. A document 70 is inserted on the feed deck 16 like a regular piece of mail at the upstream end, i.e. remote from the printing die 30. When the auto-on sensor 40 is blocked by the document 70, the motor 12 is caused to drive the rollers 18, 20, 22, 24 and 26 at about $\frac{1}{4}$ the speed normally used in a mailing machine mode. When the trip sensor 46 is blocked, the rollers 18, 20, 22, 24 and 26 stop running and the document 70 can be printed with a tax stamp 72 by depressing the print key 32, which causes the die 30 to rotate and the rollers 18, 20, 24 and 26 to feed the document 70 through the die 30 and the impression roller 22. The stamp or indicia 72 in a typical application would be printed $\frac{1}{2}$ inch from the right edge of the document 70, as indicated in FIG. 2.

Figure 3:
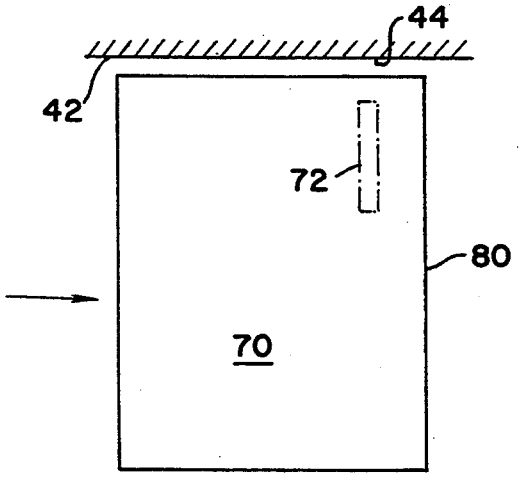
FIG. 3 is similar to FIG. 2 but shows the tax stamp as being printed in a different location more remote from the lead edge of the document.
Figure 4:
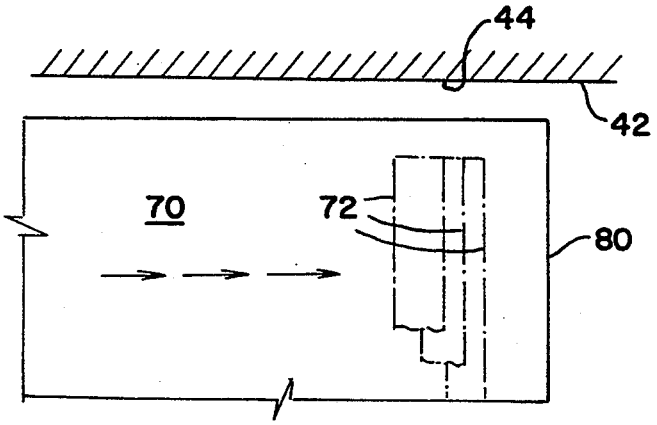
FIG. 4 is similar to FIG. 3 but shows how a document can be indexed or jogged to different positions with respect to the registration mark to effect different printing locations of the tax stamp.

In a case where the tax stamp 72 needs to be further removed from the edge 80 of the document 70, as seen in FIG. 3, the operator of the stamp machine 10 can index or jog the document 70, in intervals of $\frac{1}{4}$ inch, as seen in FIG. 4, downstream toward the rollers 24 and 26, by depressing the stepping key 34. In the normal mailing machine mode, the stepping key 34 represents the "no print" key. The stepping key 34, when depressed, causes the drive rollers 18 and 20 to rotate the appropriate distance.

The registration mark 44 indicates the print position to the operator. If the operator moves the document 70 too far downstream toward the rollers 24 and 26, the operator can eject the document 70 without printing a tax stamp 72 by continuing to "jog" the document 70 out of the drive rollers 18 and 20.

Loss of funds is prevented by requiring that the trip sensor 46 be blocked when the print key 32 is depressed.

From the foregoing description, it can be seen that a mailing machine can be converted into a tax stamp machine with no mechanical changes. The document 70 is fed into the tax machine 10 in the same fashion as a mailpiece. The rollers 18, 20, 22, 24 and 26 turn on when the auto-on sensor 40 is blocked. The drive rollers 18 and 20 bring the document 70 into the machine 10 at a low speed (6 inches per second) to minimize damage to the document 70. The rollers 18, 20, 22, 24 and 26 are stopped when the document 70 reaches the trip sensor 46. If printing were activated at this point, the indicia or stamp 72 would start at the rightmost edge 80 of the document 70. The stepping key 34 will advance the document 70 a distance of ¼ inch each time it is pressed if a different print position is desired. This stepping key 34 can also be used to eject the document 70 without printing if there is some problem. Pressing the print key 32 starts the rollers 18, 20, 22, 24 and 26 and the printing die 30. The speed of the rollers 18, 20, 22, 24 and 26 matches the speed of the printing die 30 which is about 25 inches per second and the document 70 is printed and ejected from the tax stamp machine 10.

It should be understood by those skilled in the art that various modifications may be made in the present invention without departing from the spirit and scope thereof, as described in the specification and defined in the appended claims.

What is claimed is:

1. A tax stamp machine for printing tax stamps on documents comprising:

a housing;

a registration point marked on said housing;

a feed deck for receiving documents;

means for printing a tax stamp on a portion of said documents;

a pair of drive rollers for feeding said documents to said printing means; and means for indexing said drive rollers to thereby register said documents with said registration point prior to printing said tax stamp.

2. The apparatus of claim 1, wherein said printing means comprises a modified postage meter.

3. The apparatus of claim 2, wherein said housing comprises a modified mailing machine.

4. The apparatus of claim 3, wherein said indexing means comprises a stepping key located on said mailing machine.

5. The apparatus of claim 4, additionally comprising means to actuate said modified postage meter.

6. The apparatus of claim 5, wherein said actuating means comprises a print key on said mailing machine.

7. The apparatus of claim 6, additionally comprising means for sensing the presence of a document on said feed deck and simultaneously driving said drive rollers.

8. The apparatus of claim 7, additionally comprising means for sensing that a document has reached said registration point and simultaneously stopping said drive rollers.

* * * * *